US010196806B2

(12) United States Patent
Priester

(10) Patent No.: US 10,196,806 B2
(45) Date of Patent: Feb. 5, 2019

(54) FLOOR SINK STRAINER AND ASSEMBLY

(71) Applicant: Jay R. Smith Mfg. Co., Montgomery, AL (US)

(72) Inventor: Donald E. Priester, Deatsville, AL (US)

(73) Assignee: Jay R. Smith Manufacturing Company, Montgomery, AL (US)

( * ) Notice: Subject to any disclaimer, the term of this patent is extended or adjusted under 35 U.S.C. 154(b) by 0 days.

(21) Appl. No.: 15/461,008

(22) Filed: Mar. 16, 2017

(65) Prior Publication Data

US 2018/0266094 A1 Sep. 20, 2018

(51) Int. Cl.

| | |
|---|---|
| ***E03F 5/06*** | (2006.01) |
| ***E03C 1/264*** | (2006.01) |
| ***E03F 5/04*** | (2006.01) |
| ***E03C 1/26*** | (2006.01) |

(52) U.S. Cl.

CPC ..... *E03F 5/0407* (2013.01); *E03C 1/26* (2013.01); *E03C 1/264* (2013.01); *E03F 5/06* (2013.01); *E03F 2005/068* (2013.01)

(58) Field of Classification Search

CPC .. E03F 5/04; E03F 5/0407; E03F 5/06; E03C 1/26; E03C 1/264; E04D 13/0409

USPC ..... 210/163, 164, 166; 52/302.1; 4/286, 292

See application file for complete search history.

(56) References Cited

U.S. PATENT DOCUMENTS 1,266,948 A * 5/1918 Holt ..... E04D 13/0409 210/166
1,601,498 A * 9/1926 Hirshstein ..... F16J 13/06 210/163
4,134,162 A 1/1979 Sharland et al.
4,400,272 A * 8/1983 Logsdon ..... E04D 13/0409 210/166
4,671,976 A * 6/1987 Vidal ..... E03C 1/264 4/286
5,069,781 A 12/1991 Wilkes
5,503,181 A 4/1996 Kennedy
5,535,554 A * 7/1996 Harris, Jr. ..... E04D 13/0409 210/474
5,862,535 A * 1/1999 Noga ..... E03C 1/264 4/286
6,092,244 A 7/2000 Rizzardi et al.
6,537,448 B2 3/2003 Houk
7,005,061 B1 * 2/2006 Downs ..... E03F 5/0404 210/163
7,951,292 B1 * 5/2011 De La Torre ..... E03C 1/264 210/164
8,307,469 B1 11/2012 Cohen
8,578,523 B2 11/2013 Eichler et al.
8,628,657 B1 1/2014 Robillard et al.
(Continued)

FOREIGN PATENT DOCUMENTS

GB 705094 * 3/1954

*Primary Examiner* — Christopher Upton

(74) *Attorney, Agent, or Firm* — Eric J. Sosenko; Jonathon P. O'Brien; Honigman Miller Schwartz and Cohn LLP

(57) ABSTRACT

A strainer for a floor sink and a floor sink strainer assembly. The strainer includes a central body defining a perimeter and further includes a generally planar flange extending outwardly from the perimeter of the body. The flange has a shape and size corresponding to the size and shape of the bottom wall of the floor sink. As a result, the strainer is constrained from lateral movement and lifting during a high influx of water.

14 Claims, 4 Drawing Sheets

(56) References Cited

U.S. PATENT DOCUMENTS

| | | | | |
|---|---|---|---|---|
| 9,139,996 | B2 | 9/2015 | Cohen | |
| 2009/0049594 | A1* | 2/2009 | Landsberger | E03C 1/264 4/292 |
| 2015/0233628 | A1* | 8/2015 | Farmer | E03F 5/06 210/163 |

* cited by examiner

FLOOR SINK STRAINER AND ASSEMBLY

BACKGROUND

Field of the Invention

The present invention generally relates to a strainer for a drain. More specifically, the invention relates to a strainer and a floor sink incorporating the strainer.

Description of Related Art

Floor sinks are drains mounted in the floor of commercial kitchens and other businesses. The floor sink is typically sunk into the concrete floor and connected to a waste drain system. A grate covers the opening into the floor sink, and, often, a strainer covers the exit opening in the bottom of the floor sink's catch basin. The strainer may have a variety of shapes, including flat, raised rectangular or domed. During a high influx of water into the drain, the strainer may be laterally moved and/or lifted by the in-rush of water. As a result, the exit opening to the drainage system may not be covered by the strainer and debris or other material may flow into the opening. Some prior art designs, such as the strainer described in U.S. Pat. No. 8,628,657, keep the strainer in place by mechanically attaching, such as by bolting, the strainer to the floor sink. However, such a design requires a tool for both installation and servicing.

In view of the above, it is seen that there is a need for a floor sink and strainer that filter debris from water passing through the floor sink even during periods of high water influx into the floor sink, but which do not require a tool for installation and/or servicing.

SUMMARY

In satisfying the above need, as well as overcoming the enumerated drawbacks and other limitations of the related art, the present invention provides, in one aspect, a floor sink and strainer assembly where the strainer is prevented from rising up and is constrained from lateral movement so as to stay in place and maintain its straining function during periods of high water influx.

In one aspect, the present invention provides a strainer for a floor sink, the floor sink having a bottom wall of a defined shape and size, the strainer comprising: a body having a central region and a perimeter defined about the central region, the central region including a plurality of apertures extending through the body; a generally planar flange extending outwardly from the body, the flange having a shape and size corresponding to the bottom wall of the floor sink and adapted to be supported on the bottom wall.

In another aspect, a plurality of apertures are provided in the form of a plurality of elongated slots.

In a further aspect of the invention, the plurality of apertures includes a plurality of round holes.

In an additional aspect of the invention, the flange includes a plurality of apertures extending through the flange.

In still another aspect, the plurality of apertures through the flange includes a plurality of round holes.

In yet a further aspect of the invention, the plurality of apertures through the flange have a combined area of less than fifty percent of the area of the flange.

In an additional aspect, the flange has an outer radial edge defining a rectangular shape.

In yet another aspect of the invention, the body protrudes out of a plane generally defined by the flange and forms a protruding body.

In still a further aspect, the body is dome-shaped.

In an additional aspect, the body is hemispheric in shape.

In further aspect of the invention, the body is hemispheric in shape and the flange defines a rectangular perimeter.

In another aspect, the invention provides for a floor sink and strainer assembly comprising: a receptacle including a basin for collecting water, the basin including a plurality of sidewalls and being open at one end of the side walls and generally closed at an opposing end of the sidewalls by a bottom wall, the bottom wall defining a bottom wall perimeter at a juncture with the sidewalls, the bottom wall further defining an outlet opening therein; a strainer received in the basin, the strainer including a body and a generally planar flange, the body having a central region and a body perimeter defined about the central region, the central region including a plurality of apertures extending through the body, the flange extending outwardly from the body perimeter, the flange being supported by the bottom wall and having a flange perimeter corresponding in shape and size to the bottom wall perimeter, the body being positioned in the flange so as to be located by the flange over the outlet opening; and whereby lateral movement of the strainer is constrained by the sidewalls such that the body remains located over the outlet opening during an influx of water in the floor sink and strainer assembly.

In further aspect of the invention, the floor sink and strainer assembly further includes a grate received on the open end of the basin.

In an additional aspect, the body of the strainer protrudes in a direction away from the bottom wall thereby defining a raised body relative to the flange.

In still another aspect of the invention, the body is hemispherical in shape.

In yet a further aspect, the body perimeter is round and the flange perimeter is rectangular.

In an additional aspect of the invention, proceeding about the flange perimeter, the flange has a varying width defined between the body perimeter and the flange perimeter.

In yet another aspect, the plurality of openings in the body of the strainer include elongated slots.

In still a further aspect of the invention, a plurality of apertures extend through the flange.

In an additional aspect, the plurality of apertures through the flange account for an area of less than fifty percent of the area of the flange. Further objects, features and advantages of this invention will become readily apparent to persons skilled in the art after review of the following description with reference to the drawings and the claims that are appended to inform a part of this specification.

DETAILED DESCRIPTION

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part whether or not such an access is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Figure 1:
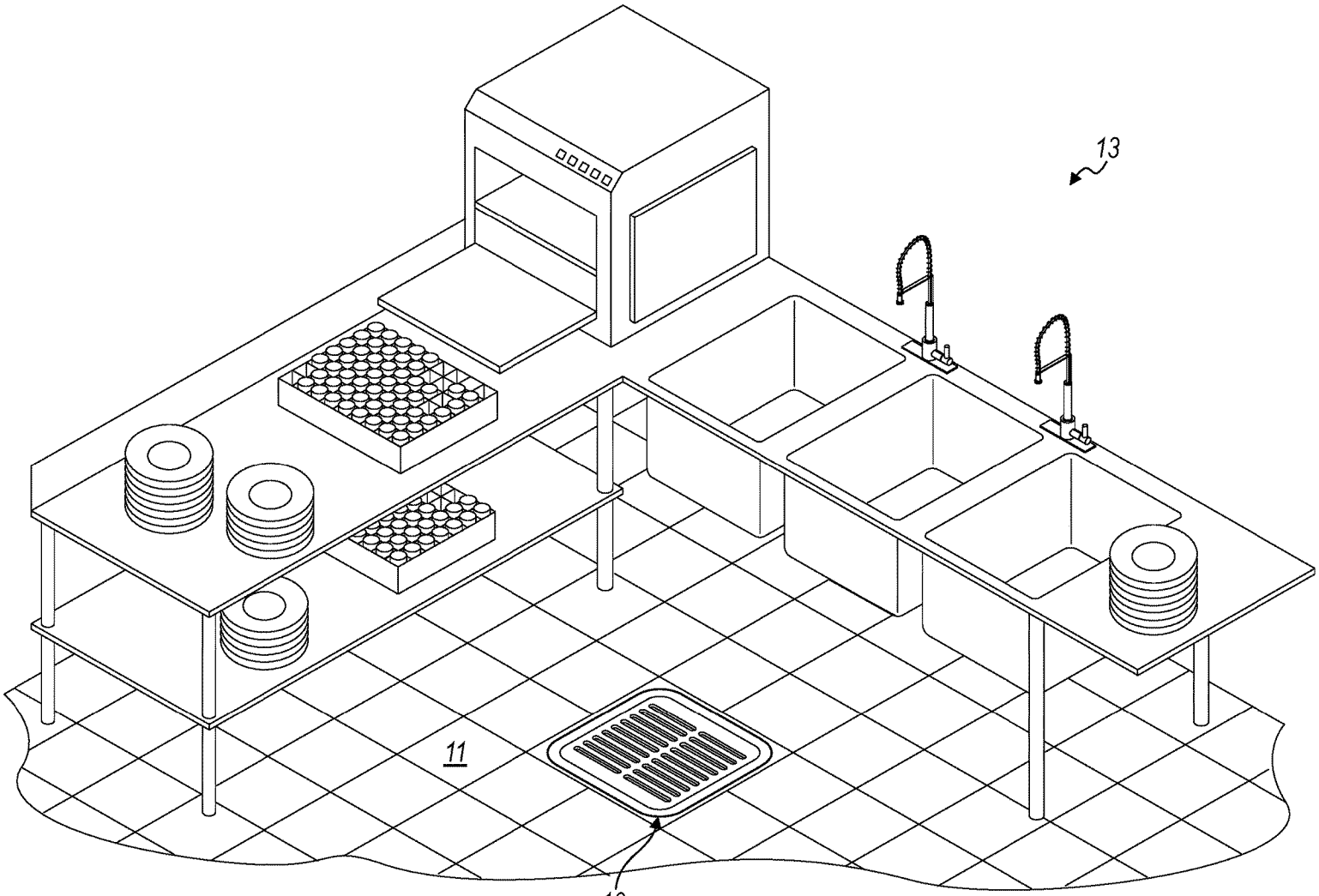
FIG. 1 is a perspective of a commercial kitchen with a floor sink embodying the principals of the present invention.

Referring now to the drawings, a floor sink assembly 10 embodying the principles of the present invention is illustrated in FIG. 1 installed in the floor 11 of a commercial kitchen 13. While illustrated, and discussed herein, in association with a kitchen floor, it will be appreciated that the floor sink assembly 10 has application beyond commercial kitchens. Accordingly, the floor sink assembly 10 will find application in a diverse variety of installations water, or other liquid, needs to be collected and handled from the floor.

Figure 2:
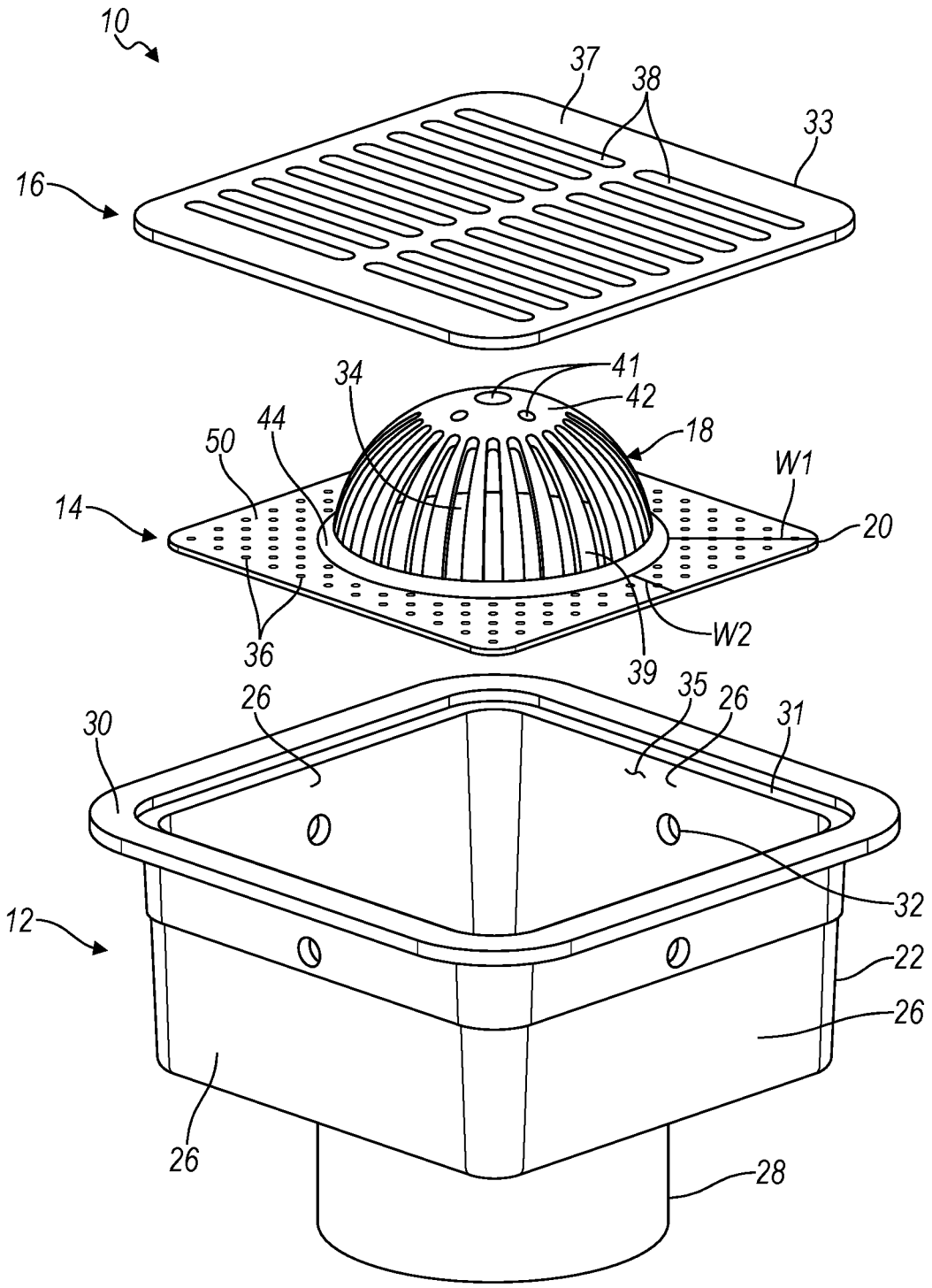
FIG. 2 is an exploded view of the floor sink including a strainer according to one aspect of the present invention.

FIG. 2 shows an exploded view of the floor sink assembly 10 (hereafter just "floor sink 10) allowing for illustration of its principal components. The floor sink 10 has, as its principal components, a receptacle 12, strainer 14, and grate 16.

The receptacle 12 includes a basin 22 defined by a bottom wall or floor 24 and a plurality of upright sidewalls 26 that enclose or encircle the bottom wall 24. As shown in FIG. 2, the sidewalls 26 define a rectangular shape, but it will be understood that the sidewalls may for any desired closed polygonal shape, and even a circular (round, oval, ovoid, etc.) shape formed by a singular or continuous sidewall. The sidewalls 26 may have one or more apertures through the sidewalls 26 for securing the receptacle 12 to the subfloor or concrete 27 of the installation site.

Along the upper edge of the sidewalls 26, the receptacle 12 includes a radially outwardly projecting flange or lip 30, which further defines on its inner perimeter a recess 31 corresponding with the top of the sidewalls 26. The grate 16, mentioned previously, corresponds in size and shape to the recess 31 so its perimeter 33 fits in and rests upon the recess 31, covering the opening 35 into the receptacle 12.

The grate 16 is substantially planar and has an upper surface 37 that is preferably flush with the top surface of the perimeter flange 30. Provided in the upper surface 37 are a plurality of apertures 38 that extend completely through the grate 16. The apertures 38 may be round holes or slots and may be arranged in the upper surface 37 in a pattern, such as parallel rows, or randomly.

The bottom wall 24 extends between and closes off the lower ends of the sidewalls 26. Defined in the bottom wall 24 is an opening or outlet 39, which may or may not be centrally located. Connected to the bottom wall 24, generally about the outlet 39, is a pipe flange 28. The pipe flange 28 is defined by a round cylindrical flange side wall 29, extending perpendicularly away from the bottom wall 24. When the floor sink 10 is installed, the pipe flange 28 connects the floor sink 10 to the drain system (not shown) of the installation site.

Figure 3:
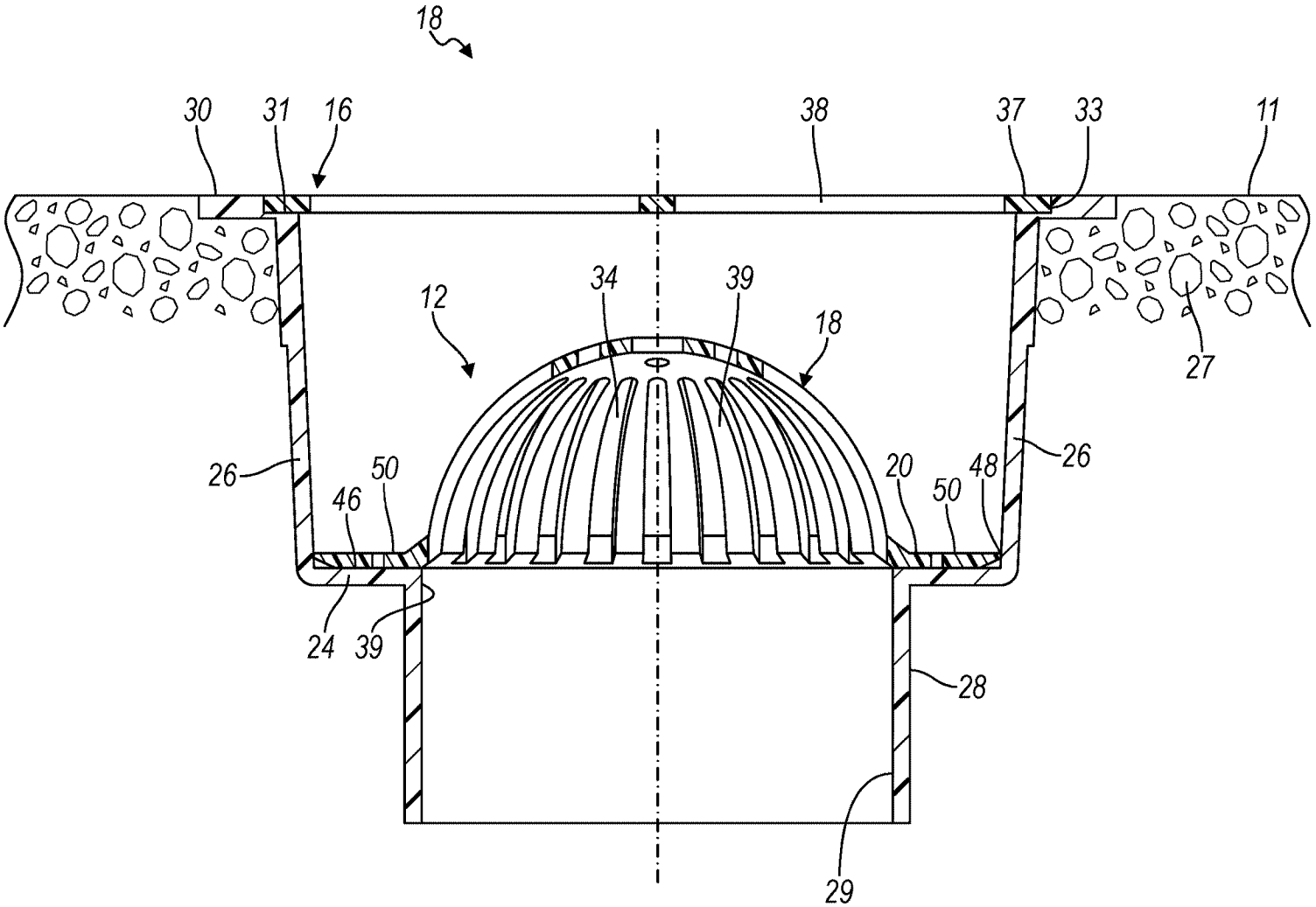
FIG. 3 is a cross-sectional view of the floor sink of FIG. 2 in an installed state in a floor.

The strainer 14 is adapted to fit within the basin 22. As seen in FIGS. 2 and 3, the strainer 14 includes has a central or raised portion 18 and a flange 20. The raised portion 18 is formed as a hollow, upwardly extending dome within the receptacle 12. The raised portion 18, hereafter just dome 18, includes a plurality of slot openings 34 extending through the wall of the dome 18 and dividing the wall into a plurality of slats 39. In addition to the slats 39, the wall of the dome 18 may include other openings 41 in the form of circular holes or other shapes. These latter openings 41 may be provided in an apex portion 42 of the dome 18. The slot openings 34 may extend longitudinally from at or near a base 44 of the dome 18 upwardly toward the apex portion 42.

The flange 20 extends radially and generally horizontally outward from the base 44 of the dome 18. Preferably, the flange 20 has a planar shape or shape that corresponds to the contour of the upper surface 46 of the bottom wall 24. The flange 20 is additionally of a size and shape such that its outer perimeter edge 48 is located adjacent to the outer extent of the bottom wall 24 and the lower end of the sidewalls 26. As used herein, the term adjacent is intended to mean that the outer perimeter edge 48 of the flange 20 extends to a point at least halfway between the outlet 39 and the sidewall 29, preferably at least ¾ths therebetween, more preferably at least ⁸⁄₁₀ths therebetween and most preferably at least ⁹⁄₁₀ths therebetween. Depending on the shape of the bottom wall 24 and sidewalls 26, the flange 20 may have a rectangular, circular or other shape. Provided in this manner, the flange 20 defines an upper face or surface that substantially covers the bottom wall 24. In the variant where the flange 20 is rectangular, the upper face 50 is seen to define different widths W1, W2 about the base 44 of the dome 18. The flange 20 may optionally include a plurality of apertures 36, such as round or other shaped holes, through it. Preferably, the surface area of the flange 20 occupied by the plurality of apertures is less than ½ of the total area of the flange 20.

Figure 4:
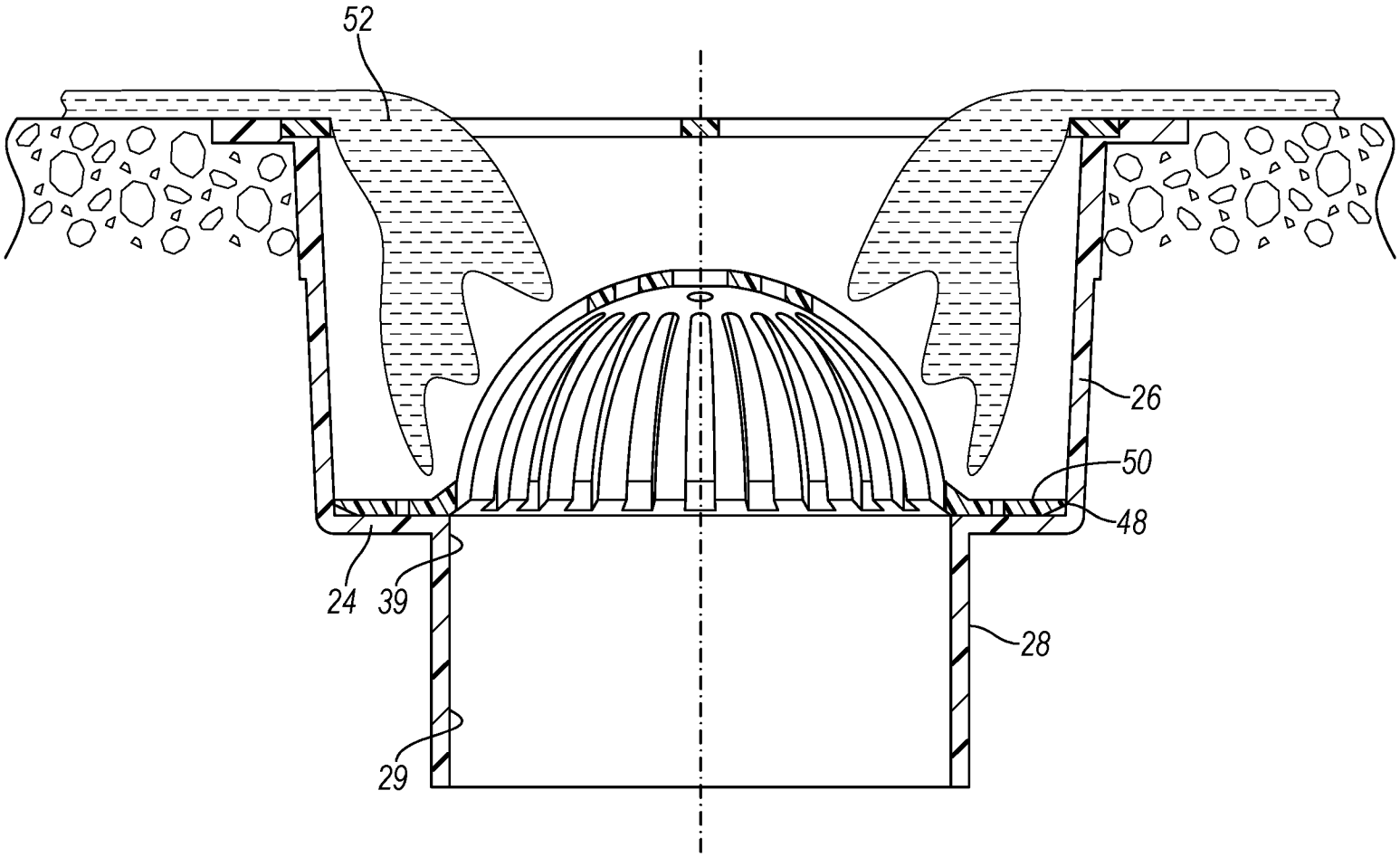
FIG. 4 is a cross-sectional view similar to that of FIG. 3, shown with water flowing into the floor sink assembly.

Referring now specifically to FIGS. 3 and 4, the floor sink 10 is shown with its principal components assembled in their regular installed positions. The strainer 14 is seated within the basin 22, resting on top of the bottom wall 24 and constrained by the width of the flange 20 and its interaction with the sidewalls 26. As seen in the figures, the dome 18 is in axial and vertical alignment above the opening 39 and the pipe flange 28. The grate 16 is seated in the recess 31 above the sidewalls 26 and constrained by the lip 30. The upper surface 37 of the grate 16 and lip 30 form a flush surface with each other and with their installed environment, e.g. a commercial kitchen floor.

As seen in FIG. 4, the floor sink 10 is shown with an influx of water 52 flowing across the floor 11, through the grate 16, into the receptacle 12 and onto the strainer 14. The water will flow through the slot openings 34 between the slats 39, through the opening 39, into the pipe flange 28, where it can exit through a wastewater drain system. The strainer 14 filters and keeps debris from passing through the pipe flange 28 into the drain system. Because of the specific construction of the flange 20, the strainer 14 is laterally constrained by the sidewalls 26 of the receptacle 12. This keeps the strainer 14 from moving laterally during periods of high water influx and keeps the dome 18 positioned above the outlet and the pipe flange 28, thereby keeping debris from entering the drain system. The strainer 14 is additionally held against the top surface of the bottom wall 24 by the downward force of water on the upper surface 50 of the flange 20. The large upper surface 50 of the flange 20 maximizes this downward force and prevents lifting of the strainer 14 off of the bottom of the receptacle 12. As apparent from the preceding discussion, there are no fasteners (screws, bolts, etc.) attaching the strainer 14 to the receptacle 12. The strainer 14 can therefore be quickly and easily installed and serviced without tools.

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A floor sink and strainer assembly comprising:

a receptacle including a basin for collecting water, the basin including a plurality of sidewalls and being open at one end of the side walls and generally closed at an opposing end of the sidewalls by a bottom wall, the bottom wall defining a bottom wall perimeter at a juncture with the sidewalls, the bottom wall further defining an outlet opening therein;

a strainer received in the basin, the strainer including a central body and a generally planar flange located about the central body, the central body defining a projection relative to the planar flange and having a plurality of apertures extending therethrough, the flange being supported by the bottom wall and having a flange perimeter extending to a position greater than halfway and less than completely between the outlet opening and bottom wall perimeter of the basin; and the sidewalls of the basin and the flange cooperating to constrain lateral movement and lifting of the strainer such that the central body remains located over the outlet opening during an influx of water into the floor sink and strainer assembly.

2. The floor sink and strainer assembly of claim 1, the flange perimeter extends a distance that is one of at least ¾ths and ⁸⁄₁₀ths of the distance between the outlet opening and the bottom wall perimeter.

3. The floor sink and strainer assembly of claim 1, the flange perimeter extends at least ⁹⁄₁₀ths of the distance between the outlet opening and the bottom wall perimeter.

4. The floor sink and strainer assembly of claim 3, wherein central body is hemispherical in shape and projects in a direction away from the outlet opening.

5. The floor sink and strainer assembly of claim 1, wherein the central body includes a round perimeter and the flange perimeter is rectangular.

6. The floor sink and strainer assembly of claim 1, wherein proceeding about the flange perimeter, the flange has a varying width defined between the central body and the flange perimeter.

7. The floor sink and strainer assembly of claim 1, wherein the plurality of openings in the central body of the strainer include elongated slots.

8. The floor sink and strainer assembly of claim 1, further comprising a plurality of apertures extending through the flange.

9. The floor sink and strainer assembly of claim 8, wherein the plurality of apertures through the flange encircle the central body and comprise an area of less than fifty percent of the area of the flange.

10. The floor sink and strainer of claim 8, wherein the plurality of apertures through the flange includes a plurality of round holes.

11. The floor sink and strainer assembly of claim 1, wherein the sidewalls of basin define a rectangular cross-section.

12. The floor sink and strainer assembly of claim 1, further comprising a radial flange extending outward from the sidewalls at the open end of the basin.

13. The floor sink and strainer assembly of claim 1, further comprising a grate coupled to the basin and extending over the open end.

14. The floor sink and strainer of claim 1, wherein the plurality of apertures extending through the central body include a plurality of round holes.

* * * * *